US006165963A

United States Patent [19]

Delroisse et al.

[11] Patent Number: 6,165,963

[45] Date of Patent: Dec. 26, 2000

[54] DETERGENT BLEACHING COMPOSITION COMPRISING PENTADENTATE LIGAND DERIVATIVES

[75] Inventors: Michel Gilbert Delroisse, Wirral, United Kingdom; Bernard Lucas Feringa, Groningen, Netherlands; Ronald Hage, Vlaardingen, Netherlands; Roelant Mathijs Hermant, Vlaardingen, Netherlands; Robertus Everardus Kalmeijer, Vlaardingen, Netherlands; Jean Hypolites Koek, Vlaardingen, Netherlands; Christiaan Lamers, Vlaardingen, Netherlands; Minze Theunis Rispens, Groningen, Netherlands; Stephen William Russell; Ronaldus Theodorus Vliet, both of Vlaardingen, Netherlands; Jane Whittaker, Wirral, United Kingdom

[73] Assignee: Unilever Home & Personal Care USA, division of Conopco, Inc., Greenwich, Conn.

[21] Appl. No.: 09/433,156

[22] Filed: Nov. 3, 1999

[30] Foreign Application Priority Data

Nov. 10, 1998 [EP] European Pat. Off. ..... 98309168

[51] Int. Cl.[7] ..... C11D 3/395; C11D 3/39

[52] U.S. Cl. ..... 510/376; 510/276; 510/286; 510/302; 510/310; 510/311; 510/312; 510/313; 510/367; 510/372; 510/375

[58] Field of Search ..... 510/276, 286, 510/302, 310, 311, 312, 313, 367, 372, 375, 376

[56] References Cited

U.S. PATENT DOCUMENTS

| | | | |
|---|---|---|---|
| 5,630,906 | 5/1997 | Boe et al. | 162/74 |

FOREIGN PATENT DOCUMENTS

| | | |
|---|---|---|
| 0 458 398 | 11/1991 | European Pat. Off. . |
| 458398 | 5/1998 | European Pat. Off. . |
| 2 692 499 | 12/1993 | France . |
| 196 05 688 | 2/1996 | Germany . |
| 197 13 851 | 4/1997 | Germany . |
| 95/34628 | 12/1995 | WIPO . |
| 97/18035 | 5/1997 | WIPO . |
| 97/48787 | 12/1997 | WIPO . |

OTHER PUBLICATIONS

International Search Report.

European Search Report.

*Primary Examiner*—Yogendra Gupta
*Assistant Examiner*—Charles Boyer
*Attorney, Agent, or Firm*—Milton L. Honig

[57] ABSTRACT

A detergent bleaching composition is provided comprising a compound including a specified pentadentate nitrogen-containing ligand. The compound can activate hydrogen peroxide or peroxyacids and provides favourable stain removal properties, particularly in the presence or iron, manganese or copper ions. In addition, an improved stability in alkaline aqueous environment has been obtained, in particular at the peroxy compound concentrations generally present in the fabric washing liquor.

20 Claims, No Drawings

DETERGENT BLEACHING COMPOSITION COMPRISING PENTADENTATE LIGAND DERIVATIVES

FIELD OF THE INVENTION

This invention relates to detergent bleaching compositions containing ligand compounds, and to methods of bleaching and cleaning substrates, especially fabric substrates, using such compositions. In particular, the present invention is concerned with compounds comprising a pentadentate ligand, for use with peroxygen bleaching agents.

BACKGROUND OF THE INVENTION

Peroxygen bleaching agents have been known for many years and are used in a variety of industrial and domestic bleaching and cleaning processes. The activity of such agents is, however, extremely temperature-dependent, and drops off sharply at temperatures below 60° C. Especially for cleaning fabrics, high temperature operation is both economically undesirable and practically disadvantageous.

One approach to solving this problem has been through the additional use of so-called bleach activators, also known as bleach precursors. These activators typically are carboxylic acid esters that react with hydrogen peroxide anions in aqueous liquor to generate the corresponding peroxyacid which, in turn, oxidises the substrate. However, these activators are not catalytic. Once the activator has been perhydrolysed, it can no longer be recycled and, therefore, it is usually necessary to use relatively high levels of activator. Since bleach activators are relatively expensive, the cost of using activators at such levels may be prohibitive.

Another approach has been to use transition metal complexes as catalysts to activate the peroxy bleaching agent. For example, U.S. Pat. No. 4,728,455 discloses the use of manganese(III)-gluconate as a peroxide bleach catalyst with high hydrolytic and oxidative stability. In EP-A-0,458,379, for example, triazacyclononane-based manganese complexes are disclosed that display a high catalytic oxidation activity at low temperatures, which is particularly suitable for bleaching purposes.

In WO-A-9534628, it has been shown that the use of iron complexes containing certain pentadentate nitrogen-containing ligands, in particular N,N-bis(pyridin-2-ylmethyl)-bis(pyridin-2-yl)methylamine ("$N_4Py$"), as bleaching and oxidation catalysts, resulted in favourable bleaching and oxidation activity. However, the synthesis of this ligand is relatively costly.

WO-A-9718035 discloses iron and manganese complexes containing ligands such as N,N'-bis(pyridin-2-ylmethyl) ethylene-1,2-diamine ("Bispicen"), N-methyl-N,N',N'-tris (pyridin-2-ylmethyl)ethylene-1,2-diamine ("TrispicMeen"), and N,N,N',N'-tetrakis(pyridin-2-ylmethyl)ethylene-1,2-diamine ("TPEN"), as peroxide oxidation catalysts for organic substrates.

WO-A-9748787 relates to iron complexes having polydentate ligands containing at least six nitrogen or oxygen hetero atoms, the metal ion being coordinated by at least five hetero atoms, for example 1,1,4,8,11,11-hexa(pyridin-2-ylmethyl)-1,4,8,11-tetra-aza-undecane ("Hptu"), as catalysts for peroxide, peroxyacid and molecular oxygen bleaching and oxidation.

Whilst known transition metal complexes have to an extent been used successfully as catalysts in detergent bleaching compositions, there remains a need for other such compositions that preferably are more effective in terms of activity or cost.

We have now surprisingly found that a significant or improved catalytic activity can be achieved in a detergent bleaching composition by using a compound having a pentadentate ligand comprising substituted or unsubstituted heteroaryl groups. Furthermore, we have found that compounds providing such activity in detergent bleaching compositions can be produced by easily accessible syntheses.

SUMMARY OF THE INVENTION

Accordingly, in one aspect, the present invention provides a detergent bleaching composition comprising:

a peroxy bleaching compound;

a surface-active material; and a compound of the general formula (A):

$$[\{M'_aL\}_bX_c]^zY_q \quad (A)$$

in which

M' represents hydrogen or a metal selected from Ti, V, Co, Zn, Mg, Ca, Sr, Ba, Na, K, and Li;

X represents a coordinating species;

a represents zero or an integer in the range from 0 to 5;

b represents an integer in the range from 1 to 4, preferably 1 to 2;

c represents zero or an integer in the range from 0 to 4;

z represents the charge of the compound and is an integer which can be positive, zero or negative;

Y represents a counter ion, the type of which is dependent on the charge of the compound;

q=z/[charge Y];

L represents a pentadentate ligand of general formula (B):

$$R^1R^1N—W—NR^1R^2 \quad (B)$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, and —$CH_2$—$C_6H_4$—$CH_2$—;

$R^2$ represents a group selected from alkyl and aryl, optionally substituted with a substituent selected from hydroxy, alkoxy, carboxylate, carboxamide, carboxylic ester, sulphonate, amine, alkylamine or $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The peroxy bleaching compound is preferably selected from hydrogen peroxide, hydrogen peroxide-liberating or -generating compounds, peroxyacids and their salts, and mixtures thereof. Preferably, the composition further comprises peroxyacid bleach precursors.

Preferably, the composition further comprises a detergency builder.

Advantageously, the compounds used in accordance with the invention have been found to provide favourable stain removal in the presence of hydrogen peroxide or peroxyacids. Also, an improved bleaching activity has been noted, particularly in alkaline aqueous solutions containing peroxy compounds at concentrations generally present in the wash liquor during the fabric washing cycle.

DETAILED DESCRIPTION OF THE INVENTION

Generally, detergent bleaching composition according to the invention may be used in the washing and bleaching of substrates including laundry, dishwashing and hard surface cleaning. Alternatively, the detergent bleaching composition of the invention may be used for bleaching in the textile, paper and woodpulp industries, as well as in waste water treatment.

As already stated, an advantage of the compounds used in accordance with the present invention is that they can provide a remarkably high oxidation activity in alkaline aqueous media in the presence of peroxy compounds.

A second advantage is that they show good bleaching activity at a broader pH range (generally pH 6–11) than observed in previously disclosed detergent bleaching compositions. Their performance was especially improved at pH of around 10. This advantage may be particularly beneficial in view of the current detergent formulations that employ rather alkaline conditions, as well as the tendency to shift the pH during fabric washing from alkaline (typically, a pH of 10) to more neutral values. Furthermore, this advantage may be beneficial when using the present compositions in machine dishwash formulations.

Another advantage is that the compounds used in the detergent bleaching compositions of the invention have a relatively low molecular weight and, consequently, are very weight-effective.

The ligand L, having the general formula $R^1R^1N—W—NR^1R^2$ as defined above, is a pentadentate ligand. By 'pentadentate' herein is meant that five hetero atoms can potentially coordinate to a metal ion, of which two hetero atoms are linked by the bridging group W and one coordinating hetero atom is contained in each of the three $R^1$ groups. Preferably, the coordinating hetero atoms are nitrogen atoms.

The ligand L comprises at least one heteroaryl group in each of the three $R^1$ groups. Preferably, the heteroaryl group is substituted, more preferably is a substituted pyridin-2-yl group, and still more preferably is a methyl- or ethyl-substituted pyridin-2-yl group linked to an N atom in the above formula via a methylene group. More preferably, the heteroaryl group is a 3-methyl-pyridin-2-yl group linked to an N atom via methylene.

The group $R^2$ is a substituted or unsubstituted alkyl, aryl or arylalkyl group, provided that $R^2$ is different from each of the groups $R^1$ in the formula above. Suitable substituents are selected from hydroxy, alkoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from $—CH_2CH_2—$, $—CH_2CH_2CH_2—$, $—CH_2CH_2CH_2CH_2—$, and $—CH_2—C_6H^4—CH_2—$ (wherein $—C_6H_4—$ can be ortho-, para-, or meta-$C_6H_4—$). Preferably, the bridging group is an ethylene or 1,4-butylene group, more preferably an ethylene group.

Examples of preferred ligands in their simplest forms are:

N-methyl-N,N',N'-tris(pyridin-2-ylmethyl)ethylene-1,2-diamine;
N-ethyl-N,N',N'-tris(pyridin-2-ylmethyl)ethylene-1,2-diamine;
N-benzyl-N,N',N'-tris(pyridin-2-ylmethyl)ethylene-1,2-diamine;
N-(2-hydroxyethyl)-N,N',N'-tris(pyridin-2-ylmethyl)ethylene-1,2-diamine;
N-(2-methoxyethyl)-N,N',N'-tris(pyridin-2-ylmethyl)ethylene-1,2-diamine;

N-methyl-N,N',N'-tris(3-methyl-pyridin-2-ylmethyl)ethylene-1,2-diamine;
N-ethyl-N,N',N'-tris(3-methyl-pyridin-2-ylmethyl)ethylene-1,2-diamine;
N-benzyl-N,N',N'-tris(3-methyl-pyridin-2-ylmethyl)ethylene-1,2-diamine;
N-(2-hydroxyethyl)-N,N',N'-tris(3-methyl-pyridin-2-ylmethyl)ethylene-1,2-diamine;
N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl)ethylene-1,2-diamine;
N-ethyl-N,N',N'-tris(5-methyl-pyridin-2-ylmethyl)ethylene-1,2-diamine;
N-benzyl-N,N',N'-tris(5-methyl-pyridin-2-ylmethyl)ethylene-1,2-diamine;
N-(2-hydroxyethyl)-N,N',N'-tris(5-methyl-pyridin-2-ylmethyl)ethylene-1,2-diamine;
N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl)ethylene-1,2-diamine;
N-ethyl-N,N',N'-tris(3-ethyl-pyridin-2-ylmethyl)ethylene-1,2-diamine;
N-benzyl-N,N',N'-tris(3-ethyl-pyridin-2-ylmethyl)ethylene-1,2-diamine;
N-(2-hydroxyethyl)-N,N',N'-tris(3-ethyl-pyridin-2-ylmethyl)ethylene-1,2-diamine;
N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl)ethylene-1,2-diamine;
N-ethyl-N,N',N'-tris(5-ethyl-pyridin-2-ylmethyl)ethylene-1,2-diamine;
N-benzyl-N,N',N'-tris(5-ethyl-pyridin-2-ylmethyl)ethylene-1,2-diamine; and
N-(2-hydroxyethyl)-N,N',N'-tris(5-ethyl-pyridin-2-ylmethyl)ethylene-1,2-diamine;
N-(2-methoxyethyl)-N,N',N'-tris(5-ethyl-pyridin-2-ylmethyl)ethylene-1,2-diamine.

N-methyl-N,N',N'-tris(3,5-dimethyl-pyrazol-1-ylmethyl)ethylene-1,2-diamine;
N-ethyl-N,N',N'-tris(3,5-dimethyl-pyrazol-1-ylmethyl)ethylene-1,2-diamine;
N-benzyl-N,N',N'-tris(3,5-dimethyl-pyrazol-1-ylmethyl)ethylene-1,2-diamine;
N-(2-hydroxyethyl)-N,N',N'-tris(3,5-dimethyl-pyrazol-1-ylmethyl)ethylene-1,2-diamine;
N-(2-methoxyethyl)-N,N',N'-tris(3,5-dimethyl-pyrazol-1-ylmethyl)ethylene-1,2-diamine;

N-methyl-N,N',N'-tris(1-methyl-benzimidazol-2-ylmethyl) ethylene-1,2-diamine;
N-ethyl-N,N',N'-tris(1-methyl-benzimidazol-2-ylmethyl) ethylene-1,2-diamine;
N-benzyl-N,N',N'-tris(1-methyl-benzimidazol-2-ylmethyl) ethylene-1,2-diamine;
N-(2-hydroxyethyl)-N,N',N'-tris(1-methyl-benzimidazol-2-ylmethyl)ethylene-1,2-diamine;
N-(2-methoxyethyl)-N,N',N'-tris(1-methyl-benzimidazol-2-ylmethyl)ethylene-1,2-diamine;

More preferred ligands are:

N-methyl-N,N',N'-tris(pyridin-2-ylmethyl)ethylene-1,2-diamine;
N-ethyl-N,N',N'-tris(pyridin-2-ylmethyl)ethylene-1,2-diamine;
N-benzyl-N,N',N'-tris(pyridin-2-ylmethyl)ethylene-1,2-diamine;
N-(2-hydroxyethyl)-N,N',N'-tris(pyridin-2-ylmethyl) ethylene-1,2-diamine;
N-(2-methoxyethyl)-N,N',N'-tris(pyridin-2-ylmethyl) ethylene-1,2-diamine;

N-methyl-N,N',N'-tris(3-methyl-pyridin-2-ylmethyl) ethylene-1,2-diamine;
N-ethyl-N,N',N'-tris(3-methyl-pyridin-2-ylmethyl)ethylene-1,2-diamine;
N-benzyl-N,N',N'-tris(3-methyl-pyridin-2-ylmethyl) ethylene-1,2-diamine;
N-(2-hydroxyethyl)-N,N',N'-tris(3-methyl-pyridin-2-ylmethyl)ethylene-1,2-diamine; and
N-(2-methoxyethyl)-N,N',N'-tris(3-methyl-pyridin-2-ylmethyl)ethylene-1,2-diamine.

The most preferred ligands are:

N-methyl-N,N',N'-tris(pyridin-2-ylmethyl)ethylene-1,2-diamine;
N-ethyl-N,N',N'-tris(pyridin-2-ylmethyl)ethylene-1,2-diamine;
N-methyl-N,N',N'-tris(3-methyl-pyridin-2-ylmethyl) ethylene-1,2-diamine; and
N-ethyl-N,N',N'-tris(3-methyl-pyridin-2-ylmethyl)ethylene-1,2-diamine.
N-(2-hydroxyethyl)-N,N',N'-tris(3-methyl-pyridin-2-ylmethyl)ethylene-1,2-diamine;

The compounds used in accordance with the invention may include suitable counter ions to balance the charge z on the compound formed by the ligand L and atoms M'. Thus, if the charge z is positive, Y may be an anion such as $R^6COO^-$, $BPh_4^-$, $ClO_4^-$, $BF_4^-$, $PF_6^-$, $R^6SO_3^-$, $R^6SO_4^-$, $SO_4^{2-}$, $NO_3^-$, $F^-$, $Cl^-$, $Br^-$, or $I^-$, with $R^6$ being H, optionally substituted alkyl or optionally substituted aryl. If z is negative, Y may be a common cation such as an alkali metal, alkaline earth metal or (alkyl)ammonium cation.

Suitable counter ions Y include those which give rise to the formation of storage-stable solids. Preferred counter ions for the preferred compounds are selected from $R^6COO^-$, $ClO_4^-$, $BF_4^-$, $PF_6^-$, $R^6SO_3^-$ (in particular $CF_3SO_3^-$), $R^6SO_4^-$, $SO_4^{2-}$, $NO_3^-$, $F^-$, $Cl^-$, $Br^-$, and $I^-$, with $R^6$ being hydrogen, optionally substituted phenyl, naphthyl or $C_1$–$C_4$ alkyl.

Suitable coordinating species X may be selected from $R^5OH$, $NR^5_3$, $R^5CN$, $R^5OO^-$, $R^5S^-$, $R^5O^-$, $R^5COO^-$, $OCN^-$, $SCN^-$, $N_3^-$, $CN^-$, $F^-$, $Cl^-$, $Br^-$, $I^-$, $O^{2-}$, $O_2^{2-}$, $O_2^-$, $NO_3^-$, $NO_2^-$, $SO_4^{2-}$, $SO_3^{2-}$, $PO_4^{3-}$ and aromatic N donors selected from pyridines, pyrazines, pyrazoles, imidazoles, benzimidazoles, pyrimidines, triazoles and thiazoles, with $R^5$ being selected from hydrogen, optionally substituted alkyl and optionally substituted aryl. X may also be the species $LM'O^-$ or $LM'OO^-$, wherein M' and L are as defined above. Preferred coordinating species X are $CH_3CN$, $H_2O$, $F^-$, $Cl^-$, $Br^-$, $OOH^-$, $O_2^{2-}$, $O_2^-$, $LM'O^-$, $LM'OO^-$, $R^5COO^-$ and $R^5O^-$ wherein $R^5$ represents hydrogen or optionally substituted phenyl, naphthyl, or $C_1$–$C_4$ alkyl.

The effective level of the compound, expressed in terms of parts per million (ppm) of ligand L in an aqueous detergent bleaching solution, will normally range from 0.001 ppm to 100 ppm, preferably from 0.01 ppm to 20 ppm, most preferably from 0.05 ppm to 10 ppm. Higher levels may be desired and applied in industrial bleaching processes, such as textile and paper pulp bleaching. The lower range levels are preferably used in domestic laundry operations.

In an embodiment of the present invention, the detergent bleaching composition is in admixture with a salt, or salt mixture, of a transition metal M. The metal M is preferably selected from iron (Fe), manganese (Mn) and copper (Cu), and combinations thereof. More preferably, the metal is Fe or Mn, and most preferably is Fe. In this embodiment, the metal M salt and compound are present in the mixture in such form that they do not produce a metal M-ligand complex during storage of the composition before use. Preferably, the metal salt and compound are in the form of discrete solids, for example as separate, optionally coated powders, particles or granules in dry mixture, or as discrete components within the same granule. Suitable processes for providing the metal salt and compound in the form of discrete solids, such as by spray drying, are known in the art.

The composition of the invention is preferably activated for use in detergent bleaching of a suitable substrate. For example, the composition can be mixed with a solution containing metal M ions, or containing any species that can provide metal M ions, to form an activated wash liquor. Alternatively, the composition can be applied to substrates containing metal M ions, for example fabrics soiled or stained with metal M-containing soils or stains. This may be particularly desirable for soil or stain targeted bleaching. Alternatively, if the composition already contains salts of metal M ions in a form discrete from the compound, then activation can be effected by dissolution of the composition in a suitable solvent, preferably in aqueous solution, for example in wash water, to form a wash liquor.

The Peroxy Bleaching Compound

The peroxy bleaching compound may be any compound which is capable of yielding hydrogen peroxide in aqueous solution, including hydrogen peroxide and hydrogen peroxide adducts. Hydrogen peroxide sources are well known in the art. They include the alkali metal peroxides, organic peroxides such as urea peroxide, and inorganic persalts, such as the alkali metal perborates, percarbonates, perphosphates, persilicates and persulphates. Mixtures of two or more such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons. The amount thereof in the composition of the invention usually will be within the range of about 2 to 35% by weight, preferably from 10 to 25% by weight.

Another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO-A-9507972, which is incorporated herein by reference. A further suitable hydrogen peroxide generating system uses a combination of glucose oxidase and glucose.

Alkylhydroxy peroxides are another class of suitable peroxy bleaching compounds. Examples of these materials include cumene hydroperoxide and t-butyl hydroperoxide.

Organic peroxyacids are also suitable as peroxy bleaching compounds. Such materials normally have the general formula:

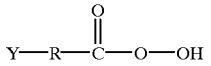

wherein R is an alkylene or alkyl- or alkylidene-substituted alkylene group containing from 1 to about 20 carbon atoms, optionally having an internal amide linkage; or a phenylene or substituted phenylene group; and Y is hydrogen, halogen, alkyl, aryl, an imido-aromatic or non-aromatic group, a —COOH or —COOOH group or a quaternary ammonium group.

Typical monoperoxyacids useful herein include, for example:

(i) peroxybenzoic acid and ring-substituted peroxybenzoic acids, e.g. peroxy-α-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid; and (viii) 4,4'-sulphonylbisperoxybenzoic acid.

Also suitable are inorganic peroxyacid compounds such as, for example, potassium monopersulphate (MPS). If organic or inorganic peroxyacids are used as the peroxygen compound, the amount thereof will normally be within the range of about 2 to 10% by weight, preferably from 4 to 8% by weight.

Generally, the detergent bleaching composition of the invention can be suitably formulated to contain from 2 to 35%, preferably from 5 to 25% by weight, of the peroxy bleaching compound.

All these peroxy compounds may be utilized either alone or in conjunction with a peroxyacid bleach precursor and/or an organic bleach catalyst not containing a transition metal.

Peroxyacid bleach precursors are known and amply described in literature, such as in the GB-A-0,836,988; GB-A-0,864,798; GB-A-0,907,356; GB-A-1,003,310 and GB-A-1,519,351; DE-A-3,337,921; EP-A-0,185,522; EP-A-0,174,132; EP-A-0,120,591; and U.S. Pat. No. 1,246,339; U.S. Pat. No. 3,332,882; U.S. Pat. No. 4,128,494; U.S. Pat. No. 4,412,934 and U.S. Pat. No. 4,675,393.

Another useful class of peroxyacid bleach precursors is that of the cationic i.e. quaternary ammonium substituted peroxyacid precursors as disclosed in U.S. Pat. No. 4,751,015 and U.S. Pat. No. 4,397,757, in EP-A-0,284,292 and EP-A-0,331,229. Examples of peroxyacid bleach precursors of this class are:

2-(N,N,N-trimethyl ammonium)ethyl sodium-4-sulphophenyl carbonate chloride—(SPCC);

N-octyl-N,N-dimethyl-$N_{10}$-carbophenoxy decyl ammonium chloride—(ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-0,303,520; EP-A-0,458,396 and EP-A-0,464,880.

Any one of these peroxyacid bleach precursors can be used in the present invention, though some may be more preferred than others. Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of the preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoyloxy benzoate; 2-(N,N,N-trimethyl ammonium)ethyl sodium-4-sulphophenyl carbonate chloride (SPCC); trimethyl ammonium toluyloxybenzene sulphonate; sodium nonanoyloxybenzene sulphonate (SNOBS); sodium 3,5,5-trimethyl hexanoyloxybenzene sulphonate (STHOBS); and the substituted cationic nitrites.

The precursors may be used in an amount of up to 12%, preferably from 2 to 10% by weight, of the composition.

The ligand-containing compound of formula (A) will be present in the detergent bleach composition of the invention in amounts so as to provide the required level in the wash liquor. Generally, the amount of compound in the detergent bleach composition is from 0.0005% to 0.5% by weight. When the dosage of detergent bleach composition is relatively low, e.g. about 1 to 2 g/l, the amount of compound in the formulation is suitably 0.001 to 0.5%, preferably 0.002 to 0.25% by weight. At higher product dosages, as used for example by European consumers, the amount of compound in the formulation is suitably 0.0002 to 0.1%, preferably 0.0005 to 0.05% by weight.

Detergent bleach compositions of the invention are effective over a wide pH-range of between 7 and 13, with optimal pH-range lying between 8 and 11.

The Surface-Active Material

The detergent bleach composition according to the present invention generally contains a surface-active material in an amount of from 10 to 50% by weight. The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals. Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; sodium and ammonium ($C_7$–$C_{12}$) dialkyl sulphosuccinates; and olefin sulphonates, which term is used to describe material made by reacting olefins, particularly ($C_{10}$–$C_{20}$) alpha-olefins, with $SO_3$ and then neutralising and hydrolysing the reaction product. The preferred anionic detergent compounds are sodium ($C_{10}$–$C_{15}$) alkylbenzene sulphonates, and sodium ($C_{16}$–$C_{18}$) alkyl ether sulphates.

Examples of suitable nonionic surface-active compounds which may be used, preferably together with the anionic surface-active compounds, include, in particular, the reaction products of alkylene oxides, usually ethylene oxide, with alkyl ($C_6$–$C_{22}$) phenols, generally 5–25 EO, i.e. 5–25 units of ethylene oxides per molecule; and the condensation products of aliphatic ($C_8$–$C_{18}$) primary or secondary linear or branched alcohols with ethylene oxide, generally 2–30 EO. Other so-called nonionic surface-actives include alkyl polyglycosides, sugar esters, long-chain tertiary amine oxides, long-chain tertiary phosphine oxides and dialkyl sulphoxides.

Amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

The detergent bleach composition of the invention will preferably comprise from 1 to 15% wt of anionic surfactant and from 10 to 40% by weight of nonionic surfactant. In a further preferred embodiment, the detergent active system is free from $C_{16}$–$C_{12}$ fatty acid soaps.

The Detergency Builder

The detergent bleach composition of the invention preferably also contains a detergency builder in an amount of from about 5 to 80% by weight, preferably from about 10 to 60% by weight.

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP-A-0,384,070.

In particular, the compositions of the invention may contain any one of the organic and inorganic builder materials, though, for environmental reasons, phosphate builders are preferably omitted or only used in very small amounts. Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is preferred that the composition contains not more than 5% by weight of a carbonate builder, expressed as sodium carbonate, more preferably not more than 2.5% by weight to substantially nil, if the composition pH lies in the lower alkaline region of up to 10.

Other Ingredients

Apart from the components already mentioned, the detergent bleach composition of the invention can contain any of the conventional additives in amounts of which such materials are normally employed in fabric washing detergent compositions. Examples of these additives include buffers such as carbonates, lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; stabilizers, such as phosphonic acid derivatives (i.e. Dequest® types); fabric softening agents; inorganic salts and alkaline buffering agents, such as sodium sulphate and sodium silicate; and, usually in very small amounts, fluorescent agents; perfumes; enzymes, such as proteases, cellulases, lipases, amylases and oxidases; germicides and colourants.

When using a hydrogen peroxide source, such as sodium perborate or sodium percarbonate, as the bleaching compound, it is preferred that the composition contains not more than 5% by weight of a carbonate buffer, expressed as sodium carbonate, more preferable not more than 2.5% by weight to substantially nil, if the composition pH lies in the lower alkaline region of up to 10.

Of the additives, transition metal sequestrants such as EDTA, and phosphonic acid derivatives such as EDTMP (ethylene diamine tetra(methylene phosphonate)) are of special importance, as not only do they improve the stability of the catalyst/$H_2O_2$ system and sensitive ingredients, such as enzymes, fluorescent agents, perfumes and the like, but also improve the bleach performance, especially at the higher pH region of above 10, particularly at pH 10.5 and above.

The invention will now be further illustrated by way of the following non-limiting examples:

EXAMPLES

Synthesis:

All reactions were performed under a nitrogen atmosphere, unless indicated otherwise. All reagents and solvents were obtained from Aldrich or Across and used as received, unless stated otherwise. Petroleum ether 40–60 was distilled using a rotavapor before using it as eluent. Flash column chromatography was performed using Merck silica gel 60 or aluminium oxide 90 (activity II–III according to Brockmann). $^1H$ NMR (300 MHz) and $^{13}C$ NMR (75 MHz) were recorded in $CDCl_3$, unless stated otherwise.

Multiplicities were addressed with the normal abbreviations using p for quintet.

Synthesis of Starting Materials for Ligand Synthesis:

Synthesis of N-benzyl amino acetonitrile. N-benzyl amine (5.35 g, 50 mmol) was dissolved in a water:methanol mixture (50 mL, 1:4). Hydrochloric acid (aq., 30%) was added until the pH reached 7.0. Added was NaCN (2.45 g, 50 mmol). After cooling to 0° C., formaline (aq. 35%, 4.00 g, 50 mmol) was added. The reaction was followed by TLC (aluminium oxide; EtOAc:$Et_3N$=9:1) until benzylamine could be detected. Subsequently the methanol was evaporated in vacuo and the remaining oil "dissolved" in water. The aqueous phase was extracted with methylene chloride (3×50 mL). The organic layers were collected and the solvent removed in vacuo. The residue was purified by Kugelrohr distillation (p=20 mm Hg, T=120° C.) giving N-benzyl amino acetonitrile (4.39 g, 30 mmol, 60%) as a colourless oil.

$^1$H NMR: δ7.37–7.30 (m, 5H), 3.94 (s, 2H), 3.57 (s, 2H), 1.67 (br s, 1H);

$^{13}$C NMR: δ137.74, 128.58, 128.46, 128.37, 127.98, 127.62, 117.60, 52.24, 36.19.

Synthesis of N-ethyl amino acetonitrile. This synthesis was performed analogously to the synthesis reported for N-benzyl amino acetonitrile. However, detection was done by dipping the TLC plate in a solution of $KMnO_4$ and heating the plate until bright spots appeared. Starting from ethylamine (2.25 g, 50 mmol), pure N-ethyl amino acetonitrile (0.68 g, 8.1 mmol, 16%) was obtained as a slightly yellow oil.

$^1$H NMR: δ3.60 (s, 2H), 2.78 (q, J=7.1, 2H), 1.22 (br s, 1H), 1.14 (t, J=7.2, 3H);

$^{13}$C NMR: δ117.78, 43.08, 37.01, 14.53.

Synthesis of N-ethyl ethylene-1,2-diamine. The synthesis was performed according to Hageman; J.Org.Chem.; 14; 1949; 616, 634, starting from N-ethyl amino acetonitrile.

Synthesis of N-benzyl ethylene-1,2-diamine. Sodium hydroxide (890 mg; 22.4 mmol) was dissolved in ethanol (96%, 20 mL), the process taking the better part of 2 hours. Added was N-benzyl amino acetonitrile (4, 2.92 g, 20 mmol) and Raney Nickel (approx. 0.5 g). Hydrogen pressure was applied (p=3.0 atm.) until hydrogen uptake ceased. The mixture was filtered over Cellite, washing the residue with ethanol. The filter should not run dry since Raney Nickel is relatively pyrophoric. The Cellite containing the Raney Nickel was destroyed by putting the mixture in dilute acid, causing gas formation). The ethanol was evaporated in in vacuo and the residue dissolved in water. Upon addition of base (aq. NaOH, 5N) the product oiled out and was extracted with chloroform (3×20 mL). After evaporation of the solvent in vacuo the $^1$H NMR showed the presence of benzylamine. Separation was enforced by column chromatography (silica gel; MeOH:EtOAc:$Et_3N$=1:8:1) yielding the benzyl amine, followed by the solvent mixture MeOH:EtOAc:$Et_3N$=5:4:1. Detection was done by using aluminium oxide as a solid phase in TLC, yielding pure N-benzyl ethylene-1,2-diamine (2.04 g, 13.6 mmol, 69%).

$^1$H NMR: δ7.33–7.24 (m, 5H), 3.80 (s, 2H), 2.82 (t, J=5.7, 2H), 2.69 (t, J=5.7, 2H), 1.46 (br s, 3H);

$^{13}$C NMR: δ140.37, 128.22, 127.93, 126.73, 53.73, 51.88, 41.66.

Synthesis of 2-acetoxymethyl-5-methyl pyridine. 2,5-Lutidine (31.0 g, 290 mmol), acetic acid (180 mL) and hydrogen peroxide (30 mL, 30%) were heated at 70–80° C. for 3 hours. Hydrogen peroxide (24 mL, 30%) was added and the subsequent mixture heated for 16 hours at 60–70° C. Most of the mixture of (probably) hydrogen peroxide, water, acetic acid, and peracetic acid was removed in vacuo (rotavap, water bath 50° C. until p=20 mbar). The resulting mixture containing the N-oxide was added dropwise to acetic anhydride heated under reflux. This reaction was highly exothermic, and was controlled by the dropping speed. After heating under reflux for an hour, methanol was added dropwise. This reaction was highly exothermic. The resulting mixture was heated under reflux for another 30 minutes. After evaporation of the methanol (rotavap, 50° C. until p=20 mbar), the resulting mixture was purified by Kugelrohr distillation (p=20 mm Hg, T=150° C.). The clear oil that was obtained still contained acetic acid. This was removed by extraction ($CH_2Cl_2$, $NaHCO_3$ (sat.)) yielding the pure acetate of 2-acetoxymethyl-5-methyl pyridine (34.35 g, 208 mmol, 72%) as a slightly yellow oil.

$^1$H NMR: δ8.43 (s, 1H), 7.52 (dd, J=7.8, J=1.7, 1H), 7.26 (d, J=7.2, 1H), 5.18 (s, 2H), 2.34 (s, 3H), 2.15 (s, 3H);

$^{13}$C NMR: δ170.09, 152.32, 149.39, 136.74, 131.98, 121.14, 66.31, 20.39, 17.66.

Synthesis of 2-acetoxymethyl-5-ethyl pyridine. This synthesis was performed analogously to the synthesis reported for 2-acetoxymethyl-5-methyl pyridine. Starting from 5-ethyl-2-methyl pyridine (35.10 g, 290 mmol), pure 2-acetoxymethyl-5-ethyl pyridine (46.19 g, 258 mmol, 89%) was obtained as a slightly yellow oil.

$^1$H NMR: δ8.47 (s, 1H), 7.55 (d, J=7.8, 1H), 7.29 (d, J=8.1, 1H), 2.67 (q, J=7.8, 2H), 2.14 (s, 3H), 1.26 (t, J=7.77, 3H);

$^{13}$C NMR: δ170.56, 152.80, 149.11, 138.47, 135.89, 121.67, 66.72, 25.65, 20.78, 15.13.

Synthesis of 2-acetoxymethyl-3-methyl pyridine. This synthesis was performed analogously to the synthesis reported for 2-acetoxymethyl-5-methyl pyridine. The only difference was the reversal of the Kugelrohr distillation and the extraction. According to $^1$H NMR a mixture of the acetate and the corresponding alcohol was obtained. Starting from 2,3-picoline (31.0 g, 290 mmol), pure 2-acetoxymethyl-3-methyl pyridine (46.19 g, 258 mmol, 89%, calculated for pure acetate) was obtained as a slightly yellow oil.

$^1$H NMR: δ8.45 (d, J=3.9, 1H), 7.50 (d, J=8.4, 1H), 7.17 (dd, J=7.8, J=4.8, 1H), 5.24 (s, 2H), 2.37 (s, 3H), 2.14 (s, 3H).

Synthesis of 2-hydroxymethyl-5-methyl pyridine. 2-Acetoxymethyl-5-methyl pyridine (30 g, 182 mmol) was dissolved in hydrochloric acid (100 mL, 4 N). The mixture was heated under reflux, until TLC (silica gel; triethylamine:ethyl acetate:petroleum ether 40–60=1:9:19) showed complete absence of the acetate (normally 1 hour). The mixture was cooled, brought to pH>11, extracted with dichloromethane (3×50 mL) and the solvent removed in vacuo. Pure 2-hydroxymethyl-5-methyl pyridine (18.80 g, 152 mmol, 84%) was obtained by Kugelrohr distillation (p=20 mm Hg, T=130° C.) as a slightly yellow oil.

$^1$H NMR: δ8.39 (s, 1H), 7.50 (dd, J=7.8, J=1.8, 1H), 7.15 (d, J=8.1, 1H), 4.73 (s, 2H), 3.83 (br s, 1H), 2.34 (s, 3H);

$^{13}$ C NMR: δ156.67, 148.66, 137.32, 131.62, 120.24, 64.12, 17.98.

Synthesis of 2-hydroxymethyl-5-ethyl pyridine. This synthesis was performed analogously to the synthesis reported for 2-hydroxymethyl-5-methyl pyridine. Starting from 2-acetoxymethyl-5-ethyl pyridine (40 g, 223 mmol), pure 2-hydroxymethyl-5-ethyl pyridine (26.02 g, 189 mmol, 85%) was obtained as a slightly yellow oil.

$^{1}$H NMR: δ8.40 (d, J=1.2, 1H), 7.52 (dd, J=8.0, J=2.0, 1H), 7.18 (d, J=8.1, 1H), 4.74 (s, 2H), 3.93 (br s, 1H), 2.66 (q, J=7.6, 2H), 1.26 (t, J=7.5, 3H);

$^{13}$C NMR: δ156.67, 148.00, 137.87, 136.13, 120.27, 64.07, 25.67, 15.28.

Synthesis of 2-hydroxymethyl-3-methyl pyridine. This synthesis was performed analogously to the synthesis reported for 2-hydroxymethyl-5-methyl pyridine. Starting from 2-acetoxymethyl-3-methyl pyridine (25 g (recalculated for the mixture), 152 mmol), pure 2-hydroxymethyl-3-methyl pyridine (15.51 g, 126 mmol, 83%) was obtained as a slightly yellow oil.

$^{1}$H NMR: δ8.40 (d, J=4.5, 1H)), 7.47 (d, J=7.2, 1H), 7.15 (dd, J=7.5, J=5.1, 1H), 4.85 (br s, 1H), 4.69 (s, 1H), 2.22 (s, 3H);

$^{13}$C NMR: δ156.06, 144.97, 137.38, 129.53, 121.91, 61.38, 16.30.

Synthesis of Ligands:

Synthesis of N-methyl-N,N',N'-tris(pyridin-2-ylmethyl) ethylene-1,2-diamine (L1). The ligand L1 (comparative) was prepared according to Bemal, Ivan; Jensen, Inge Margrethe; Jensen, Kenneth B.; McKenzie, Christine J.; Toftlund, Hans; Tuchagues, Jean-Pierre; J.Chem.Soc.Dalton Trans.; 22; 1995; 3667–3676.

Synthesis of N-methyl-N,N',N'-tris(3-methylpyridin-2-ylmethyl)ethylene-1,2-diamine (L2, Me-TRILEN). 2-Hydroxymethyl-3-methyl pyridine (5.00 g, 40.7 mmol) was dissolved in dichloromethane (30 mL). Thionyl chloride (30 mL) was added dropwise under cooling (ice bath). The resulting mixture was stirred for 1 hour and the solvents removed in vacuo (rotavap, until p=20 mm Hg, T=50° C.). To the resultant mixture was added dichloromethane (25 mL). Subsequently NaOH (5 N, aq.) was added dropwise until the pH (aqua)≧11. The reaction was quite vigorous in the beginning, since part of the thionyl chloride was still present. N-methyl ethylene-1,2-diamine (502 mg, 6.8 mmol) and additional NaOH (5 N, 10 mL) were added. The reaction mixture was stirred at room temperature for 45 hours. The mixture was poured into water (200 mL), and the pH checked (≧14, otherwise addition of NaOH (aq. 5N)). The reaction mixture was extracted with dichloromethane (3 or 4×50 mL, until no product could be detected by TLC). The combined organic phases were dried and the solvent removed in vacuo. Purification was enforced as described before, yielding N-methyl-N,N',N'-tris(3-methylpyridin-2-ylmethyl)ethylene-1,2-diamine as a slightly yellow oil. Purification was enforced by column chromatography (aluminium oxide 90 (activity II–III according to Brockmann); triethylamine:ethyl acetate:petroleum ether 40–60=1:9:10) until the impurities were removed according to TLC (aluminium oxide, same eluent, Rf≈0.9). The compound was eluted using ethylacetate:triethyl amine=9:1. N-methyl-N',N'-tris(3-methylpyridin-2-ylmethyl)ethylene-1,2-diamine (L2, 1.743 g, 4.30 mmol, 63%) was obtained.

$^{1}$H NMR: δ8.36 (d, J=3.0, 3H), 7.40–7.37 (m, 3H), 7.11–7.06 (m, 3H), 3.76 (s, 4H), 3.48 (s, 2H), 2.76–2.71 (m, 2H), 2.53–2.48 (m, 2H), 2.30 (s, 3H), 2.12 (s, 6H), 2.05 (s, 3H);

$^{13}$C NMR: δ156.82, 156.77, 145.83, 145.67, 137.61, 133.14, 132.72, 122.10, 121.88, 62.32, 59.73, 55.19, 51.87, 42.37, 18.22, 17.80.

Synthesis of N-ethyl-N,N',N'-tris(3-methylpyridin-2-ylmethyl)ethylene-1,2-diamine (L3, Et-TRILEN). This synthesis is performed analogously to the synthesis for L2. Starting from 2-hydroxymethyl-3-methyl pyridine (25.00 g, 203 mmol) and N-ethyl ethylene-1,2-diamine (2.99 g, 34.0 mmol), N-ethyl-N,N',N'-tris(methylpyridin-2-ylmethyl) ethylene-1,2-diamine (L3, 11.49 g, 28.5 mmol, 84%) was obtained. Column chromatography (aluminium oxide; $Et_3N$:EtOAc:petroleum ether 40–60=1:9:30, followed by $Et_3N$:EtOAc=1:9).

$^{1}$H NMR: δ8.34–8.30 (m, 3H), 7.40–7.34 (m, 3H), 7.09–7.03 (m, 3H), 3.71 (s, 4H), 3.58 (s, 2H), 2.64–2.59 (m, 2H), 2.52–2.47 (m, 2H), 2.43–2.36 (m, 2H), 2.31 (s, 3H), 2.10 (s, 6H), 0.87 (t, J=7.2, 3H);

$^{13}$C NMR: δ157.35, 156.92, 145.65, 137.61, 133.14, 132.97, 122.09, 121.85, 59.81, 59.28, 51.98, 50.75, 48.02, 18.27, 17.80, 11.36.

Synthesis of N-benzyl-N,N',N'-tris(3-methylpyridin-2-ylmethyl)ethylene-1,2-diamine (L4, Bn-TRILEN). This synthesis is performed analogously to the synthesis for L2. Starting from 2-hydroxymethyl-3-methylpyridine (3.00 g 24.4 mmol), and N-benzyl ethylene-1,2-diamine (610 mg, 4.07 mmol), N-benzyl-N,N'N'-tris(3-methylpyridin-2-ylmethyl)ethylene-1,2-diamine (L4, 1.363 g, 2.93 mmol, 72%) was obtained. Column chromatography (aluminium oxide; $Et_3N$:EtOAc:petroleum ether 40–60=1:9:10).

$^{1}$H NMR: δ8.33–8.29 (m, 3H), 7.37–7.33 (m, 3H), 7.21–7.03 (m, 8H), 3.66 (s, 4H), 3.60 (s, 2H), 3.42 (s, 2H), 2.72–2.67 (m, 2H), 2.50–2.45 (m, 2H), 2.23 (s, 3H), 2.03 (s, 6H);

$^{13}$C NMR: δ157.17, 156.96, 145.83, 145.78, 139.29, 137.91, 137.80, 133.45, 133.30, 128.98, 127.85, 126.62, 122.28, 122.22, 59.99, 58.83, 51.92, 51.54, 18.40, 17.95.

Synthesis of N-hydroxyethyl-N,N',N'-tris(3-methylpyridin-2-ylmethyl)ethylene-1,2-diamine (L5). This synthesis is performed analogously to the synthesis for L6. Starting from 2-hydroxymethyl-3-methyl pyridine (3.49 g, 28.4 mmol), and N-hydroxyethyl ethylene-1,2-diamine (656 mg 6.30 mmol), after 7 days N-hydroxyethyl-N,N',N'-tris (3-methylpyridin-2-ylmethyl)ethylene-1,2-diamine (L5, 379 mg, 0.97 mmol, 14%) was obtained.

$^{1}$H NMR: δ8.31–8.28 (m, 3H), 7.35–7.33 (m, 3H), 7.06–7.00 (m, 3H), 4.71 (br s, 1H), 3.73 (s, 4H), 3.61 (s, 2H), 3.44 (t, J=5.1, 2H), 2.68 (s, 4H), 2.57 (t, J=5.0, 2H), 2.19 (s, 3H), 2.10 (s, 6H);

$^{13}$C NMR: δ157.01, 156.88, 145.91, 145.80, 137.90, 137.83, 133.30, 131.89, 122.30, 121.97, 59.60, 59.39, 57.95, 56.67, 51.95, 51.22, 18.14, 17.95.

Synthesis of N-methyl-N,N',N'-tris(5-methylpyridin-2-ylmethyl)ethylene-1,2-diamine (L6). 2-hydroxymethyl-5-methyl pyridine (2.70 g, 21.9 mmol) was dissolved in dichloromethane (25 mL). Thionyl chloride (25 mL) was added dropwise under cooling (ice bath). The resulting mixture was stirred for 1 hour and the solvents removed in vacuo (rotavap, until p=20 mm Hg, T±35° C.). The remaining oil was used directly in the synthesis of the ligands, since it was known from the literature that the free picolyl chlorides are somewhat unstable and are highly lachrymatory. To the resultant mixture was added dichloromethane (25 mL) and N-methyl ethylene-1,2-diamine (360 mg, 4.86 mmol). Subsequently NaOH (5 N, aq.) was added dropwise. The reaction was quite vigorous in the beginning, since part of the thionyl chloride was still present. The aqueous layer was brought to pH=10, and additional NaOH (5 N, 4.38 mL) was added. The reaction mixture was stirred until a sample indicated complete conversion (7 days). The reaction mixture was extracted with dichloromethane (3×25 mL). The combined organic phases were dried and the solvent removed in vacuo. Purification was enforced by column chromatography (aluminium oxide 90 (activity II–III according to Brockmann); triethylamine:ethyl acetate:petroleum petroleum ether 40–60=1:9:10) until the impurities were removed according to TLC (aluminium oxide, same eluent, Rf≈0.9). The compound was eluted using ethyl acetate:triethyl amine=9:1, yielding N-methyl-N,N',N'-tris (5-methylpyridin-2-ylmethyl)ethylene-1,2-diamine (L6, 685 mg, 1.76 mmol, 36%) as a slightly yellow oil.

$^{1}$H NMR: δ8.31 (s, 3H) 7.43–7.35 (m, 5H), 7.21 (d,J=7.8, 1H), 3.76 (s, 4H), 3.56 (s, 2H), 2.74–2.69 (m, 2H), 2.63–2.58 (m, 2H), 2.27 (s, 6H), 2.16 (s, 3H);

$^{13}$C NMR: δ156.83, 156.43, 149.23, 149.18, 136.85, 136.81, 131.02, 122.41, 122.30, 63.83, 60.38, 55.53, 52.00, 42.76, 18.03.

Synthesis of N-methyl-N,N',N'-tris(5-ethylpyridin-2-ylmethyl)ethylene-1,2-diamine (L7). This synthesis is performed analogously to the synthesis for L6. Starting from 2-hydroxymethyl-5-ethyl pyridine (3.00 g, 21.9 mmol), and N-methyl ethylene-1,2-diamine (360 mg, 4.86 mmol), after 7 days N-methyl-N,N',N'-tris(5-ethylpyridin-2-ylmethyl) ethylene-1,2-diamine (L7, 545 mg, 1.26 mmol, 26%) was obtained.

$^{1}$H NMR: δ8.34 (s, 3H), 7.44–7.39 (m, 5H), 7.26 (d, J=6.6, 1H), 3.80 (s, 4H), 3.59 (s, 2H), 2.77–2.72 (m, 2H), 2.66–2.57 (m, 8H), 2.18 (s, 3H), 1.23 (t, J=7.5, 9H);

$^{3}$C NMR: δ157.14, 156.70, 148.60, 148.53, 137.25, 135.70, 122.59, 122.43, 63.91, 60.48, 55.65, 52.11, 42.82, 25.73, 15.36.

Experimental:

Experiments were carried out in a temperature-controlled glass beaker equipped with a magnetic stirrer, thermocouple and a pH electrode. The bleach experiments are carried out at 40 and 60° C. In examples when formulations are used, the dosage amounted to about 5 g/l total formulation. The composition of the base formulation without bleach is described below:

| Detergent formulation: | |
|---|---|
| Anionic surfactant: | 9% |
| Nonionic surfactant: | 7% |
| Soap: | 1% |
| Zeolite: | 30% |
| Polymers: | 3% |
| Sodium carbonate: | 7% |
| Enzyme granules: | 1% |
| Sodium silicate: | 5% |
| Sodium citrate: | 3.5% |
| Dequest ® 2047: | 1% |
| Percarbonate: | 19% |
| TAED granule (83%) | 5.5% |
| Water and minors: | 8% |

In total 8.6 mmol/1 $H_2O_2$ was used, dosed in the form of sodium percarbonate. The pH was adjusted at 10.0. The bleaching process took place for 30 minutes.

Tea-stained test cloths (BC-1) were used as bleach monitor. After the bleach experiment, the cloths were rinsed in tap water and dried in a tumble drier. The reflectance ($R_{460}$*) was measured before and after the wash on a Minolta® CM 3700d spectrophotometer. The average was taken of 2 test cloths. The differences in reflectance, expressed as ΔR values, are given in the tables below.

Example 1

An iron perchlorate solution (4 ml ethanol) was first added to 800 ml percarbonate buffer (8.7 mmol/1) pH 10 solution (yielding 8.7 mmol/1 hydrogen peroxide and 10 μM Fe solution) that contains two BC-1 cloths. Subsequently, a ligand solution (4 ml ethanol) was added. After 30 minutes at 40° C. (pH 10.2) the bleach results were as follows:

| | ΔR: |
|---|---|
| Blank (no ligand): | 9.0 points |
| with ligand L2 (45 μM): | 14.4 points |
| with ligand L3 (43 μM): | 12.3 points |

Example 2

The same procedure was carried out as in Example 1, but in a detergent formulation containing percarbonate (no TAED) in a representative wash liquor: 10 μM Fe, 4.7 μM Cu, 0.3 μM Zn, pH 9.9:

| | ΔR: |
|---|---|
| Blank (no ligand): | 9.2 points |
| with ligand L2 (45 μM): | 11.9 points |
| with ligand L3 (43 μM): | 10.0 points |

These results show that bleach activation in a detergent composition can be effective using free ligands in accordance with the invention, without the need for premixing of metal salts with the ligands or the dosing of well-defined metal-ligand complexes.

The structures of the ligands L1 to L7 is shown below:

L1

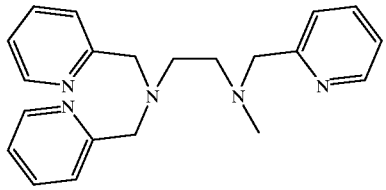

L2

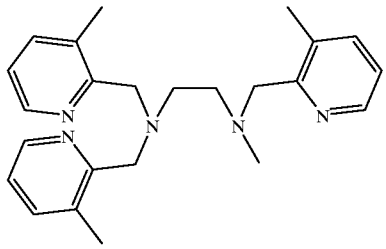

L3

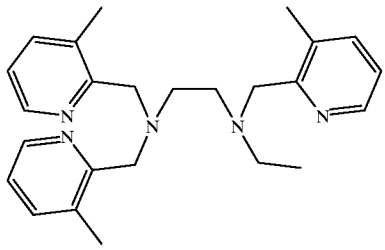

-continued

L4

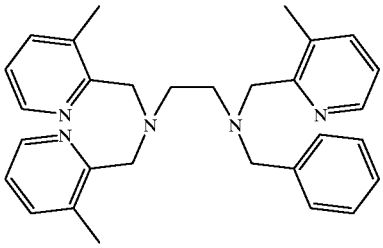

L5

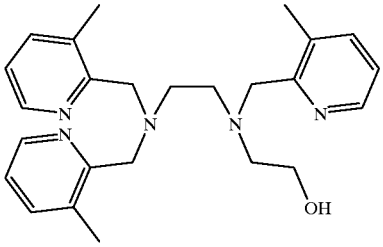

L6

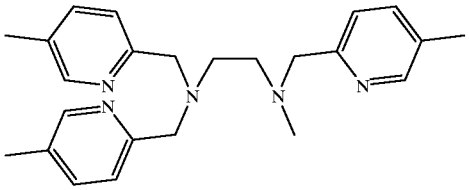

L7

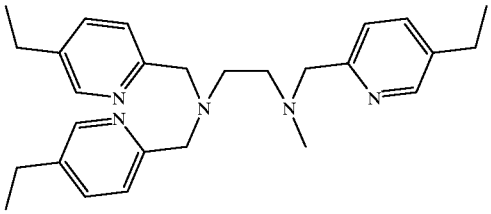

What is claimed is:

1. A detergent bleaching composition comprising:

a peroxy bleaching compound;

a surface-active material; and a compound of the general formula (A):

$$[\{M'_aL\}_bX_c]^zY_q \quad (A)$$

in which

M' represents hydrogen or a metal selected from the group consisting of Ti, V, Co, Zn, Mg, Ca, Sr, Ba, Na, K, and Li;

X represents a coordinating species;

a represents zero or an integer in the range from 0 to 5;

b represents an integer in the range from 1 to 4;

c represents zero or an integer in the range from 0 to 4;

z represents the charge of the compound and is an integer which can be positive, zero or negative;

Y represents a counter ion, the type of which is dependent on the charge of the compound;

q=z/[charge Y];

L represents a pentadentate ligand of general formula (B):

$$R^1R^1N—W—NR^1R^2 \quad (B)$$

wherein each $R^1$ independently represents —$R^3$—V, in which $R^3$ represents an optionally substituted group selected from the group consisting of alkylene, alkenylene, oxyalkylene, aminoalkylene or alkylene ether, and V represents an optionally substituted heteroaryl group selected from the group consisting of pyridinyl, pyrazinyl, pyrazolyl, imidazolyl, benzimidazolyl, pyrimidinyl, triazolyl and thiazolyl;

W represents an optionally substituted alkylene bridging group selected from the group consisting of —$CH_2CH_2$—, —$CH_2CH_2CH_2$—, —$CH_2CH_2CH_2CH_2$—, and —$CH_2$—$C_6H_4$—$CH_2$—;

$R_2$ represents an alkyl or aryl group optionally substituted with a substituent selected from the group consisting of hydroxy, alkoxy, carboxylate, carboxamide, carboxylic ester, sulphonate, amine, alkylamine and $N^+(R^4)_3$, wherein $R^4$ is selected from the group consisting of hydrogen, alkanyl, alkenyl, arylalkanyl, arylalkenyl, oxyalkanyl, oxyalkenyl, aminoalkanyl, aminoalkenyl, alkanyl ether and alkenyl ether.

2. A composition according to claim 1, wherein W represents ethylene.

3. A composition according to claim 1, wherein V represents a substituted aryl group selected from the group consisting of pyridinyl, pyrazinyl, pyrazolyl, imidazolyl, benzimidazolyl, pyrimidinyl, triazolyl and thiazolyl.

4. A composition according to claim 1, wherein V represents substituted pyridin-2-yl.

5. A composition according to claim 1, wherein $R^3$ represents methylene and V represents methyl-substituted or ethyl-substituted pyridin-2-yl.

6. A composition according to claim 4, wherein V represents 3-methyl pyridin-2-yl.

7. A composition according to claim 1, wherein $R^2$ represents a group selected from the group consisting of methyl, ethyl, benzyl, 2-hydroxyethyl, and 2-methoxyethyl.

8. A composition according to claim 1, wherein the ligand L is N-methyl-N,N',N'-tris(3-methyl-pyridin-2-ylmethyl) ethylene-1,2-diamine or N-ethyl-N,N',N'-tris(3-methyl-pyridin-2-ylmethyl)ethylene-1,2-diamine.

9. A composition according to claim 1, wherein X represents a coordinating species selected from the group consisting of $CH_3CN$, $H_2O$, $F^-$, $Cl^-$, $Br^-$, $OOH^-$, $O_2^{2-}$, $O_2^-$, $R^5COO^-$, $R^5O^-$, $LMO^-$, and $LMOO^-$ wherein $R^5$ represents hydrogen or optionally substituted phenyl, naphthyl, or $C_1$–$C_4$ alkyl.

10. A composition according to claim 1, wherein the counter ion Y is selected from the group consisting of $R^6COO^-$, $ClO_4^-$, $BF_4^-$, $PF_6^-$, $R^6SO_3^-$, $R^6SO_4^-$, $SO_4^{2-}$, $NO_3^-$, $F^-$, $Cl^-$, $Br^-$, and $I^-$, wherein $R^6$ represents hydrogen or optionally substituted phenyl, naphthyl or $C_1$–$C_4$ alkyl.

11. A composition according to claim 1, wherein the peroxy bleaching compound is selected from the group consisting of hydrogen peroxide, hydrogen peroxide-liberating or generating compounds, peroxyacids and their salts, and mixtures thereof, optionally together with peroxy-acid bleach precursors.

12. A composition according to claim 1, further comprising a detergency builder.

13. A composition according to claim 1, comprising the surface-active material in an amount of from 10 to 50% by weight, and the detergency builder in an amount of from 5 to 80% by weight.

14. A composition according to claim 1, in admixture with a salt of a metal selected from iron, manganese and copper.

15. A composition according to claim 14 wherein the metal is iron.

16. A composition according to claim 14, wherein the metal salt and the compound (A) are discrete solids.

17. A composition according to claim 1, comprising the peroxy bleaching compound in an amount of from 2 to 35% by weight and the compound (A) in an amount of from 0.0005 to 0.5% by weight.

18. A method of bleach cleaning which comprises admixing a composition as defined in claim 1 with an aqueous solution comprising a salt of a metal selected from iron, manganese and copper to form an activated wash liquor, and applying the activated wash liquor to a substrate to be cleaned.

19. A method according to claim 18 wherein the metal is iron.

20. A method of bleach cleaning which comprises admixing a composition as defined in claim 14 with water to form an activated wash liquor, and applying the activated wash liquor to a substrate to be cleaned.

* * * * *